US011697529B2

(12) United States Patent
Batzel et al.

(10) Patent No.: US 11,697,529 B2
(45) Date of Patent: Jul. 11, 2023

(54) FLOW GATE POUR CLOSURE

(71) Applicant: RB INNOVATIONS, LLC, Jessup, PA (US)

(72) Inventors: Zachary (Rocky) Batzel, Moscow, PA (US); Daniel Jepson, Cranesville, PA (US)

(73) Assignee: RB INNOVATIONS, LLC, Jessup, PA (US)

( * ) Notice: Subject to any disclaimer, the term of this patent is extended or adjusted under 35 U.S.C. 154(b) by 0 days.

(21) Appl. No.: 16/292,170

(22) Filed: Mar. 4, 2019

(65) Prior Publication Data

US 2023/0135726 A1 May 4, 2023

(51) Int. Cl.
*B65D 43/20* (2006.01)
*B65D 50/04* (2006.01)

(52) U.S. Cl.
CPC ..... *B65D 43/20* (2013.01); *B65D 50/04* (2013.01); *B65D 2215/02* (2013.01)

(58) Field of Classification Search
CPC ..... B65D 43/20; B65D 43/22; B65D 43/14; B65D 50/04; B65D 50/02
USPC ..... 220/812, 811, 810, 212.5, 661, 345.4, 220/351, 350, 345.3, 345.2, 345.1; 222/625
See application file for complete search history.

(56) References Cited

U.S. PATENT DOCUMENTS 2,224,093 A * 12/1940 Leathers ..... A47L 9/149 55/369
3,422,988 A * 1/1969 LaFranca ..... A47K 10/427 220/815
3,949,899 A * 4/1976 Jacobs ..... B65D 43/20 220/345.3
9,365,333 B2 6/2016 Batzel
9,919,837 B2 3/2018 Batzel

* cited by examiner

*Primary Examiner* — Robert J Hicks
(74) *Attorney, Agent, or Firm* — Reed F. Lerner

(57) ABSTRACT

A flow gate pour closure for regulated dispersal of a flowing content from a container comprises a closure body and a sliding gate with a depressible tab. The closure body has a principal aperture aligned with a principal opening of the container to allow for the content to flow therethrough. The sliding gate is translatable through a gate exit aperture of the closure body within the gate track to block the principal aperture and prevent the content from flowing or to expose the principal aperture to partially or completely allow the content to flow at a variable flow rate. The sliding gate is translatable reciprocally back along the slide track to re-block the principal aperture. The tab depressible partially engages the top collar when the sliding gate fully blocks the principal aperture and is arranged so that depressing the tab enables sliding gate movement through the gate exit aperture.

20 Claims, 9 Drawing Sheets

FLOW GATE POUR CLOSURE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure and prior art pertains to sliding closures for containers and more particularly to a flow gate pour closure incorporated to any form of container used to regulate the dispersal of substances from said container. Said substances primarily include, but are not limited to, substances in granular, powder, or sand like forms. Examples include substances used for non-consumable means, such as kitty litter, ice melt/rock salt, and powdered laundry detergent, as well as consumable substances such as protein powders and seasoning for commercial restaurants.

(2) Description of Related Art Including Information Disclosed Under 37 CFR 1.97 and 1.98

Currently most containers or packages that hold powders, sands, or granular substances come in either a large rigid plastic container or a large rigid cardboard box. In either case, substances are often dispensed from said container by removing a torque dependent threaded cap, flipping a lid open via a natural hinge, or by penetrating a hole at the top of container. For large quantity needs, the packages must be lifted upside down to pour the substance to an intended area of use. This is seen with kitty litter being poured into a litter box. Since the majority of these substances have high densities and are supplied in large quantities to fulfill their intended need, a very heavy package is required that is often awkward and challenging to dispense from. Not only is this a physical burden on the consumer, but it also gives consumers a predisposition to incur numerous acute or chronic injuries. To accommodate for the awkward pouring means of such substances, it is not atypical to dispense such material from the container at a height that leads to significant dust or debris during pour. Minimizing the height at which a substance needs to travel to reach an intended area without excessive physical strain, in particular with regulated flow, would be an optimal scenario. This scenario, along with others, is what the present invention will address.

U.S. Pat. No. 9,365,333 to Batzel et al. and U.S. Pat. No. 9,919,837 to Batzel, collectively referred to herein as the "Batzel patents", disclose certain push and slide type safety closures. The containers and closures described in the Batzel patents provide a childproof container closure but are not designed for vertical orientation or to produce a controlled flow of a substance held in the container. There is an ongoing need for improvement and/or application alternative functions for sliding closure designs. The sliding closures described herein address this need.

BRIEF SUMMARY OF THE INVENTION

An embodiment of the disclosure meets the needs presented above by generally comprising a closure body configured to seal a principal opening of a container for a flowing content with the principal opening positioned on a vertical wall of the closure body proximal a bottom wall thereof such that the content flows freely from an inside of the container therethrough. The closure body comprises a landing surface, a top collar, and a gate track. The landing surface has a front surface and a back surface with a principal aperture extending from the front surface through the back surface. The principal aperture is aligned with the principal opening of the container to allow for the content to flow therethrough. The top collar perpendicularly extends from a perimeter of the landing surface on the front side. The top collar has an inner face and an outer face with a gate exit aperture extending from the inner face through the outer face. The gate track receives a sliding gate through the gate exit aperture and extends from a top side to a bottom side of the top collar. The gate track is defined by a gliding surface extending from the inner face of the top collar adjacent the gate exit aperture. The gliding surface is in spaced apart opposition to the landing surface. The sliding gate blocks the principal aperture to prevent the content from flowing therethrough. The sliding gate is slidingly translatable through the gate exit aperture within the gate track to expose the principal aperture to partially or completely allow the content to flow therethrough at a variable flow rate. The sliding gate is translatable reciprocally back along the slide track to re-block the principal aperture. The sliding gate itself blocks the principal aperture and is constructed and arranged so that depressing a tab towards the sliding gate enables sliding gate movement through the gate exit aperture and translation back through the gate exit aperture. The tab partially engages the top collar when the sliding gate fully blocks the principal aperture.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1A:
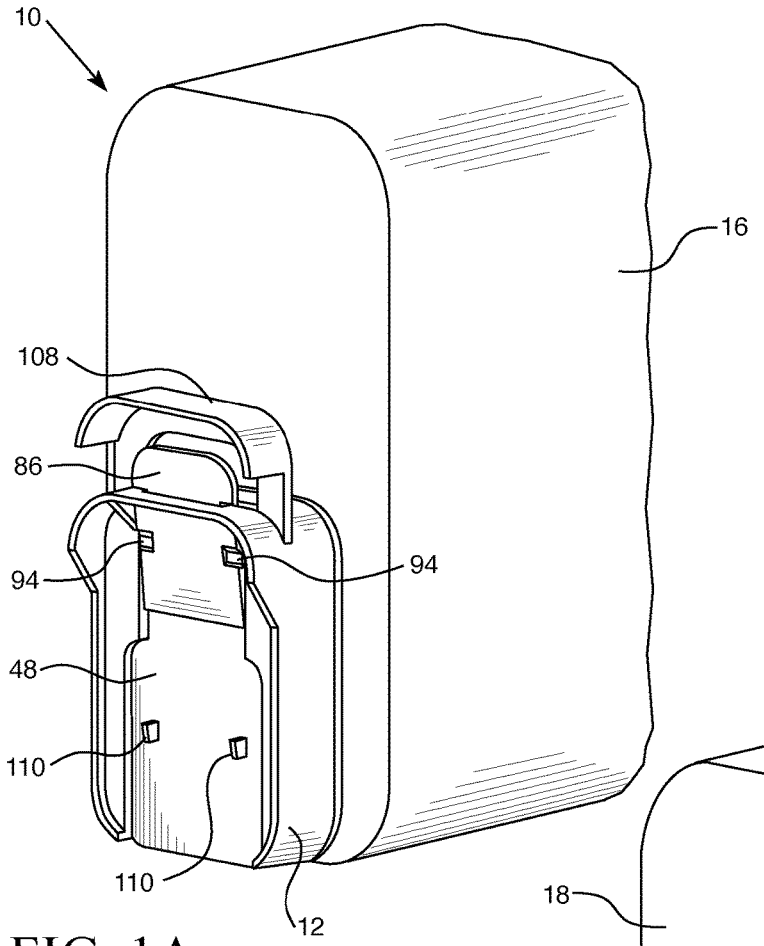
FIG. 1A shows an isometric view of a flow gate closure unit in a closed position according to an embodiment of the disclosure.
Figure 1B:
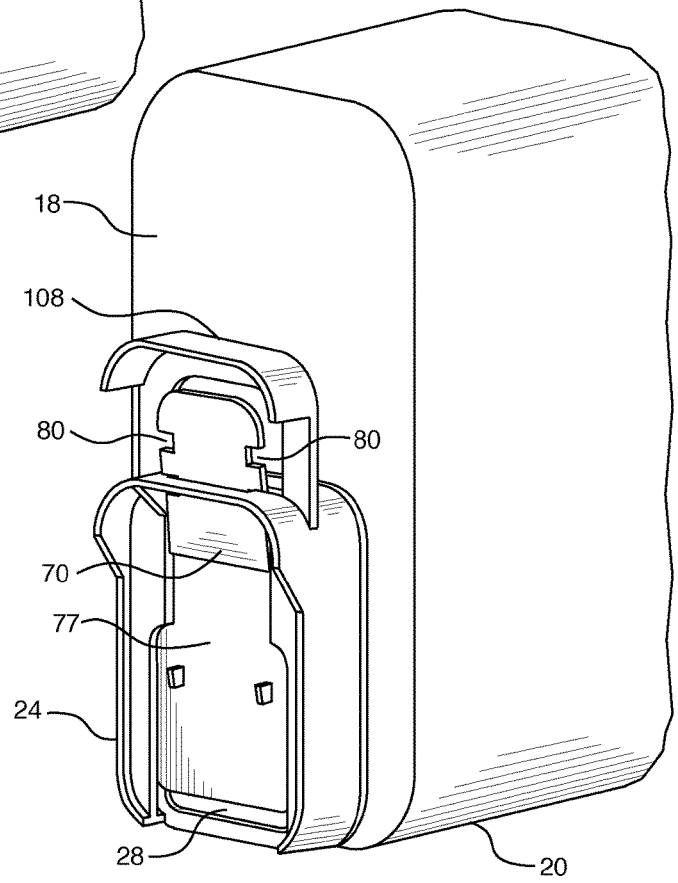
FIG. 1B shows an isometric view of the flow gate closure unit in a first sprinkle flow position according to an embodiment of the disclosure.
Figure 1C:
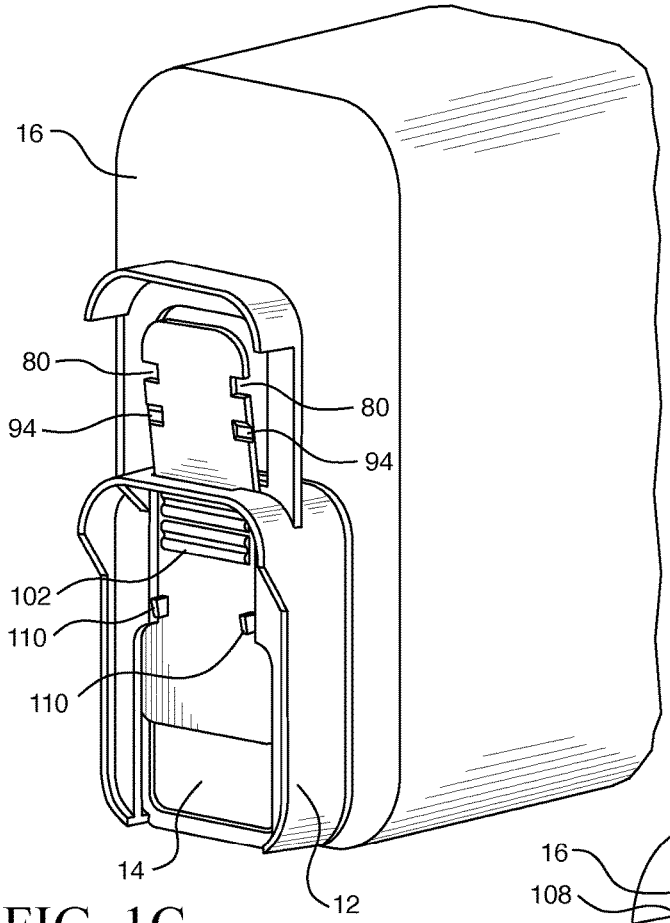
FIG. 1C shows an isometric view of the flow gate closure unit in a second sprinkle flow position according to an embodiment of the disclosure.

With reference now to the drawings, and in particular to FIGS. 1 through 5B thereof, a new door motion detector embodying the principles and concepts of an embodiment of the disclosure and generally designated by the reference numeral 10 will be described.

As best illustrated in FIGS. 1 through 5B, the flow gate pour closure 10 generally comprises a closure body 12 configured to seal a principal opening 14 of a container 16 for a flowing content with the principal opening 14 positioned on a vertical wall 18 of the container proximal a bottom wall 20 thereof such that the content flows freely from an inside of the container therethrough. Said content primarily includes, but is not limited to, substances in granular, powder, or sand like forms. Examples include substances used for non-consumable means, such as kitty litter, ice melt/rock salt, and powdered laundry detergent, as well as consumable substances such as protein powders and seasoning for commercial restaurants. The closure to be described may have other usages for containers of other solids, including discrete or monolithic solids, semisolids and certain gels, and fluids, including Newtonian fluids and non-Newtonian fluids. Examples of such contents include, but are not limited to, pills, tablets, capsules, gelatins and "gummy bear"-like formulations, liquids of any kind, wafers, leaves, sheets of perforated blister container tablets, powders, shampoos, lotions, and nicotine products.

The closures described herein may comprise the closure body 12 being integral with the container 16 or may alternatively comprise the closure body being adapted to mate with a separate container. In the case where the closure body is produced separately from the container, the mating may be achieved by an adhesive bonding, thermal bonding, inductive bonding, ultrasonic bonding, or any other method of attachment suitable for use in mating closures to containers in a substantially permanent fashion. Mechanical attachment methods may include threading, a snap-fit element, or a press-fit element on the closure body configured to mate with a complementary element on the container.

The closure body 12 comprises a landing surface 22, a top collar 24, and a gate track 26. The landing surface 22 has a principal aperture 28 extending from a front surface 30 through a back surface 32. The principal aperture 28 is aligned with the principal opening 14 of the container to allow for the content to flow therethrough. The top collar 24 perpendicularly extends from a perimeter of the landing surface on the front side. A top side 34 of the top collar has a gate exit aperture 36 extending from an inner face 38 through an outer face 40. The gate exit aperture 36 may comprise a gate port 42 port adjacent the landing surface 22 and a tab port 44 extending above the gate port 42. The tab port 44 may be stepped.

The gate track 26 extends from the top side to a bottom side 46 of the top collar to receive a sliding gate 48 through the gate port 42 of the gate exit aperture. The gate track 26 is defined by a gliding surface 50 extending from the inner face 38 of the top collar in spaced apart opposition to the landing surface 22. The gliding surface 50 may continuously extend from the top side 34 adjacent a left side 52 of the gate exit aperture around the bottom side 46 to the top side 34 adjacent a right side 54 of the gate exit aperture. The gliding surface 50 may also have a wider portion 56 adjacent the top side 34 of the top collar and a lower rim 58 connecting the wider portion 56 adjacent each of the left side 52 and the right side 54. The wider portion 56 increases contact area with the sliding gate 48 to improve stability and increase pressure while the lower rim 58 has a profile corresponding to the principal aperture 28. A pair of beam supports 60 may extend from the inner face 38 of the top collar on each side of the gate exit aperture 36 to the gliding surface 50 in order to provide structural integrity to a beam portion 62 of the top collar above the gate exit aperture 36.

Figure 2A:
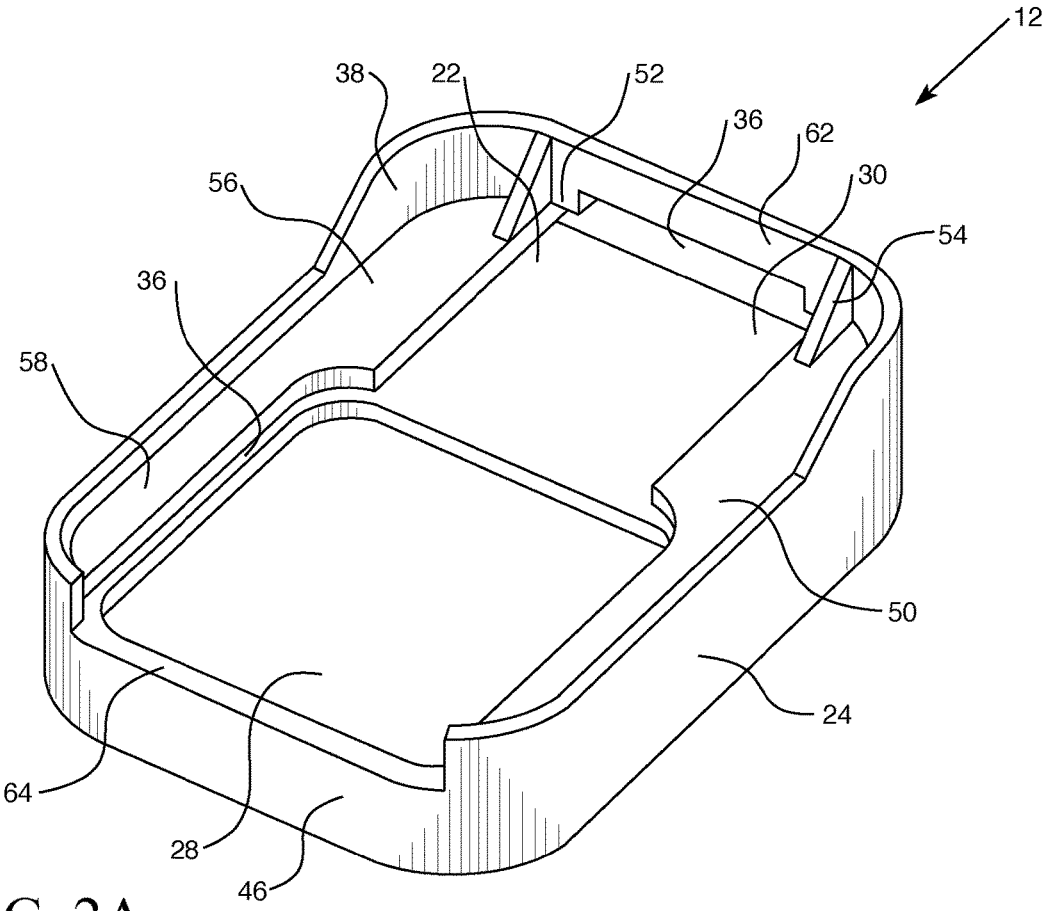
FIG. 2A shows an isometric view of the closure body of the flow gate closure unit according to an embodiment of the disclosure.
Figure 2B:
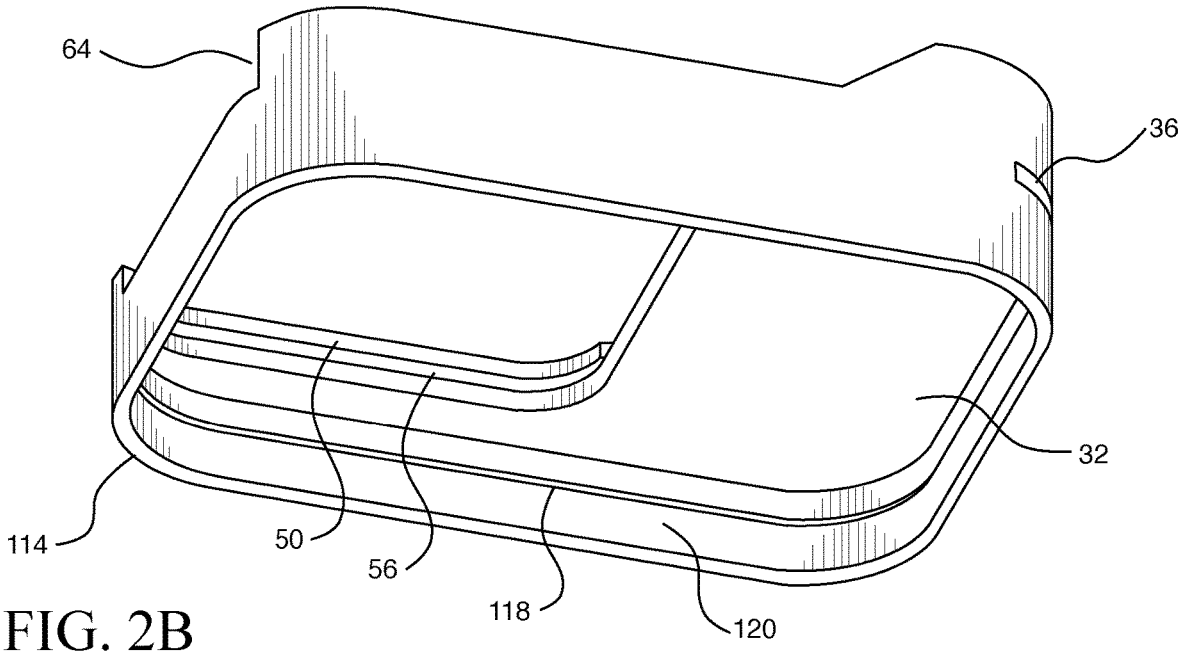
FIG. 2B shows an isometric view of the closure body of the flow gate closure unit according to an embodiment of the disclosure.
Figure 2C:
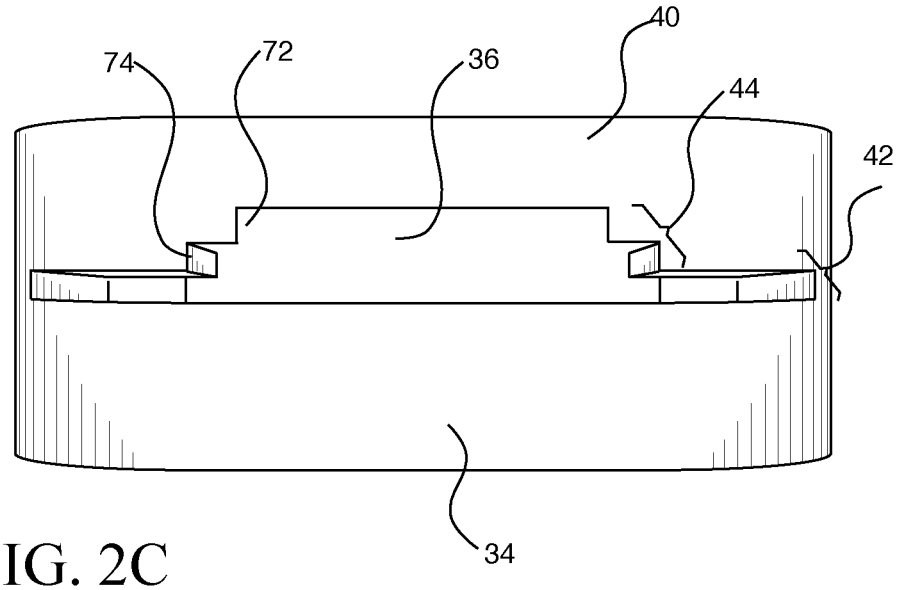
FIG. 2C shows a top plan view of the closure body of the flow gate closure unit according to an embodiment of the disclosure.
Figure 2D:
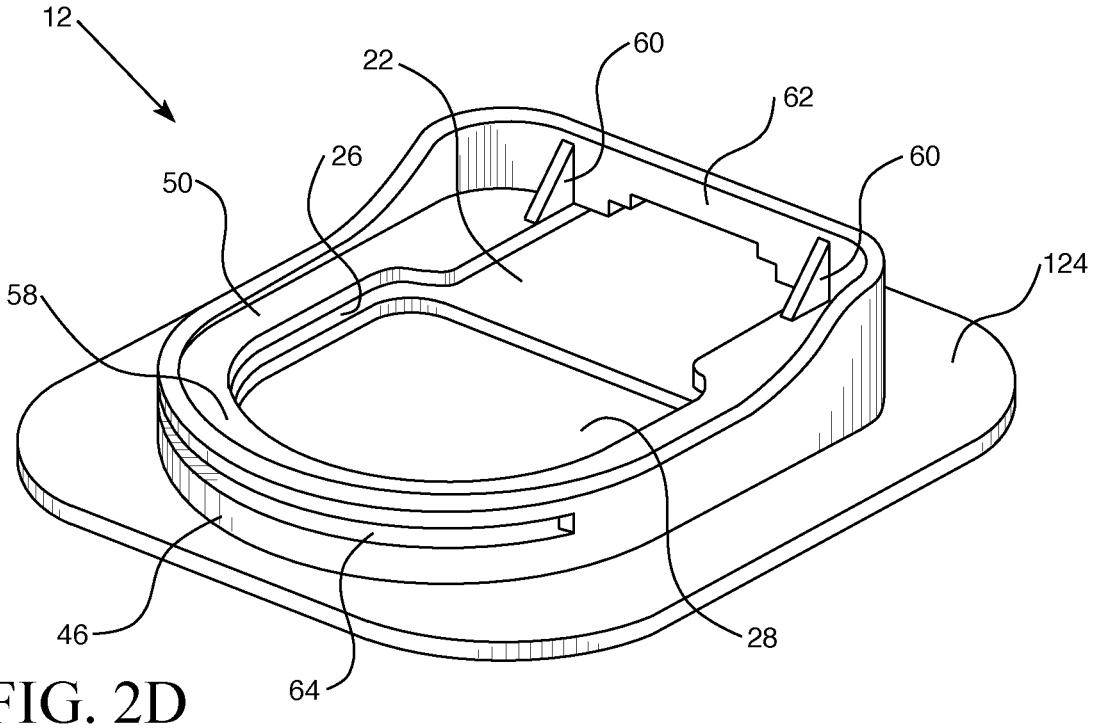
FIG. 2D shows an isometric view of the closure body of the flow gate closure unit according to an embodiment of the disclosure.

The top collar 24 may have an overflow channel 64 for clearing the gate track of debris, particularly when the content is of powdered form. The overflow channel 64 extends from the inner face 38 through the outer face 40 of the bottom side 46 of the top collar. The overflow channel 64 may fully occupy the bottom side 46 of the top collar as seen in FIGS. 2A and 2B, in which case it also removes that portion of the gliding surface 50, or may alternatively be a slot through the bottom side 46 of the top collar as seen in FIG. 2D. Each of the bottom side 46 of the top collar, a bottom edge 66 of the sliding gate, and the lower rim 58 of the gliding surface may be rounded or semi-circular to produce a more controlled flow from the principal aperture and to funnel debris towards the overflow channel.

The sliding gate 48 blocks the principal aperture 28 to prevent the content from flowing therethrough. The sliding gate 48 is slidingly translatable through the gate exit aperture 36 within the gate track 26 to partially expose the principal aperture 28 in a plurality of sprinkle flow positions shown in FIGS. 1B, 1C, and 4B or completely expose the principal aperture in a fully open position shown in FIG. 1D, thus allowing the content to flow therethrough at a variable flow rate. The sliding gate 48 is translatable reciprocally back along the gate track 26 to re-block the principal aperture 28 in a closed position shown in FIGS. 1A and 5B, thus stopping the flow of the content. The sliding gate's perpendicular path in relation to the substance flow is the optimal method for cutting off the flow of the substance easily and immediately. Along with the natural "guillotine action" of the sliding gate 48 for easy and efficient flow stoppage, the sliding gate 48 may have a channel extension 68 on the bottom edge 66 to eradicate any excess substance and clear the gate track 26 of debris when the sliding gate is moved to the closed position to fully block the principal aperture 28 with the channel extension 68 engaging the overflow channel 64. The channel extension 68 and the overflow channel 64 can be strategically sized, shaped and positioned depending on the substance being dispensed. The channel extension 68 may be tapered or sharpened to more effectively cut off the flow of substance.

The sliding gate 48 comprises a depressible tab 70 that partially engages the beam portion 62 of the top collar when the sliding gate 48 fully blocks the principal aperture 28 and is constructed and arranged so that depressing the tab 70 towards the sliding gate 48 enables sliding gate movement through the gate exit aperture 36 and translation back through the gate exit aperture 36. The beam portion 62 may be shaped in accordance with the design of the tab 70 to make the tab port 44 stepped. The tab 70 may partially engage a top tier 72 of the tab port 44 and can slide through a second tier 74 of the tab port when depressed. The tab 70 can be depressed by modest pressure (e.g., from a hand, finger(s) or thumb of an adult) and is biased such that it will rebound when the pressure is released. The force required to depress the tab 70 can be adjusted during production for different applications and target users, particularly to increase child resistance or to aid seniors or disabled users. The tab 70 may be of cantilever form with a proximal end 76 fixed on an outer surface 77 of the sliding gate and an unfixed free distal end 78. The tab 70 is not limited to cantilever form and may alternatively be an array of depressible extensions included a reflexive button. The force is adjusted by adjusting the length of the tab, the thickness of the tab, and/or the amount of contact area at the fulcrum.

FIGS. 1A-1D, 3A, 4A and 4B show that the tab 70 may have a pair of locking notches 80 extending from a front face 82 through a rear face 84 of the tab below a tongue extension 86 at the distal end 78. The tongue extension 86 extends past the top tier 72 of the tab port and the pair of locking notches 80 engages the top collar 24 when the sliding gate 48 fully blocks the principal aperture 28. The pair of locking notches 80 thus maintains the sliding gate 48 in the closed position until the tab 70 is depressed by the tongue extension 86 such that it passes through the second tier 74 of the tab port. FIGS. 3B, 5A, and 5B show that the tab 70 may alternatively have a body portion 88 extending from the proximal end 76 and a head portion 90 extending from the body portion 88 to the distal end 78. The head portion 90 is thinner than the body portion 88 to form a pair of shoulders 92. The head portion 90 extends through the top tier 72 and the pair of shoulders 92 engages the top collar 24 when the sliding gate 48 is in the closed position to prevent the sliding gate 48 from sliding. The tab 70 is depressible by the head portion 90 such that the pair of shoulders 92 and the body portion 88 can slide through the second tier 74 of the tab port.

FIGS. 1A-1D, 3A, 4A and 4B show that the tab may have at least one pair of flow notches 94 extending from the front face 82 towards, but not through, the rear face 84 of the tab. Each of the at least one pair of flow notches 94 has an angled ramp side 96 more proximal the distal end 78 of the tab, an angled lodge side 98 more proximal the proximal side 76 of the tab, and a flat portion 100 between the ramp side 96 and the lodge side 98. The flat portion 100 engages the beam portion 62 of the top collar to maintain the sliding gate 48 partially lifted in one of the plurality of sprinkle flow positions. The ramp side 96 is angled to allow for disengagement with the beam portion 62 of the top collar by pushing the sliding gate 48 closed without manually depressing the tab 70 to allow for quick stoppage of flow. The lodge side 98 may be angled to allow for disengagement with the top collar 24 without manually depressing the tab 70 by pulling the sliding gate 48 further open, or alternatively may be perpendicular the flat portion 100 to require manual depression of the tab 70 for disengagement with the top collar 24 while pulling the sliding gate 48 further open to prevent an accidental increase in flow rate. There may also be at least one pair of flow ridges 102 fixed on the outer surface 77 of the sliding gate below the tab 70. Each of the at least one pair of flow ridges 102 partially engages the top collar 24 to require a slight increase in force to move through the gate exit aperture 36 when translating the sliding gate 48 to expose or re-block the principal aperture 28, securing the sliding gate 48 in sprinkle flow positions between each pair of flow ridges 102 and creating a "ratchet" type movement. Each flow ridge 102 may be rounded or angled. The at least one pair of flow notches 94 and the at least one pair of flow ridges 102 maintain the sprinkle flow positions and allow the content of the container to pour at controlled, calibrated flow rates.

Figure 3A:
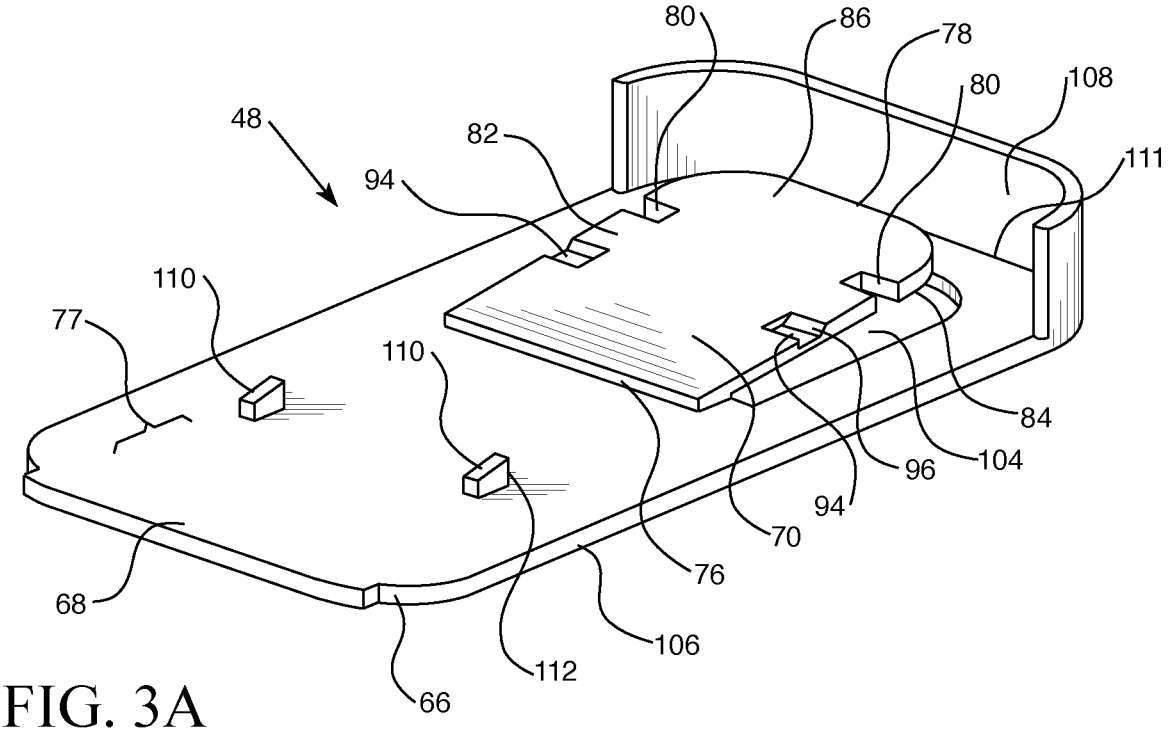
FIG. 3A shows an isometric view of the sliding gate of the flow gate closure unit according to an embodiment of the disclosure.
Figure 3B:
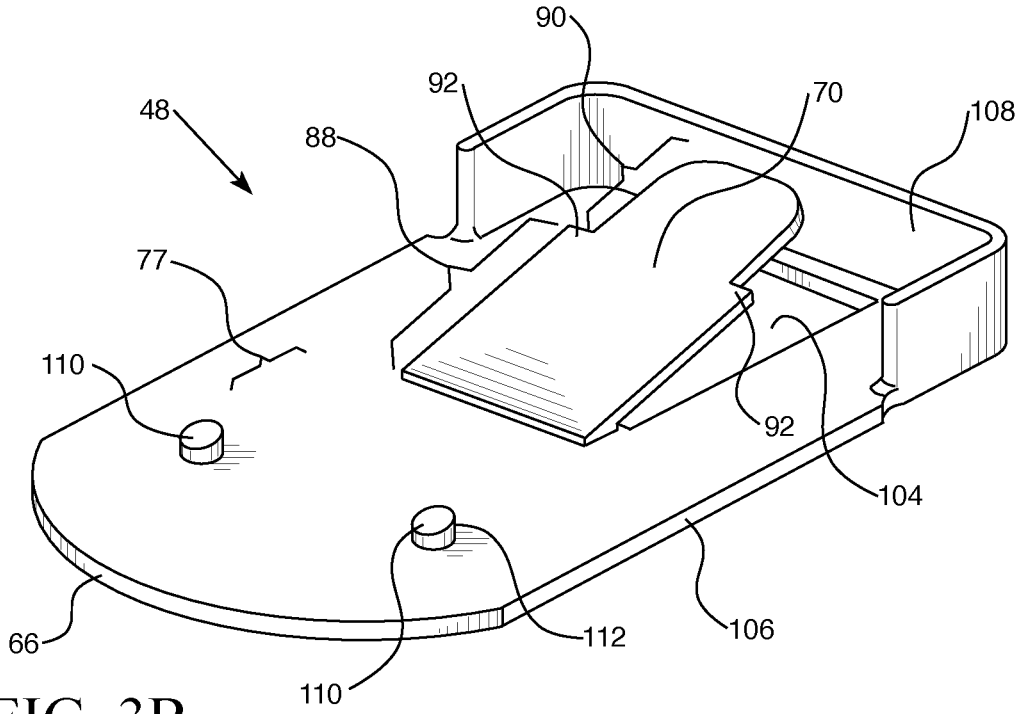
FIG. 3B shows an isometric view of the sliding gate of the flow gate closure unit according to an embodiment of the disclosure.

FIGS. 3A and 3B show the sliding gate 48 may have a production aperture 104 extending from the outer surface 77 through an inner surface 106. The production aperture 104 extends from adjacent the proximal end 76 of the tab to beneath the distal end 78 because the tab 70 is formed from the same piece of material as the sliding gate 48 during manufacturing, thus simplifying tooling and accelerating production. There may also be a pull handle 108 coupled to the sliding gate 48 perpendicularly extending from a top edge 111 of the sliding gate. The pull handle 108 provides an area from which a user can lift and depress the sliding gate 48, particularly while depressing the tab 70, allowing for one-handed operation.

Figure 1D:
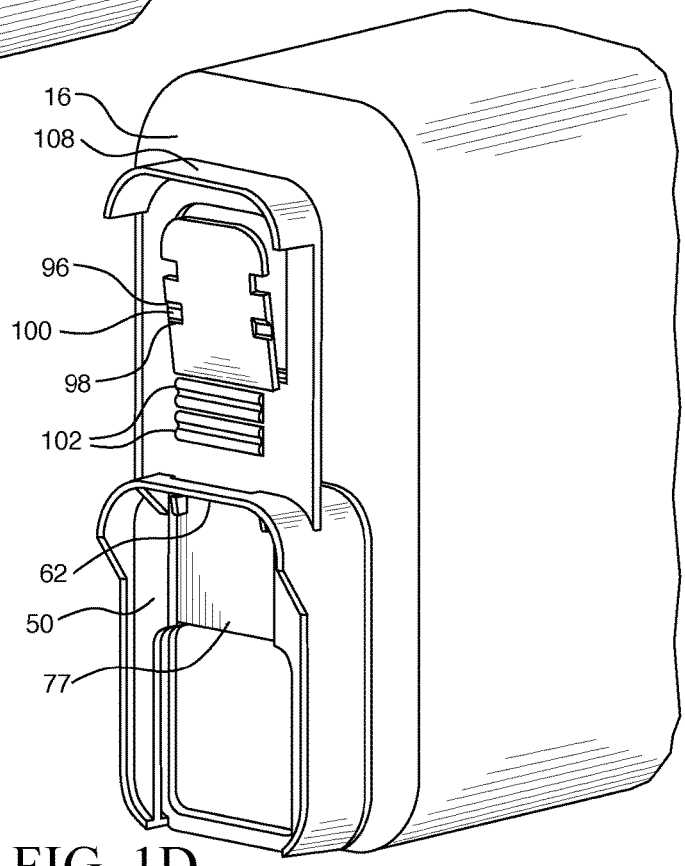
FIG. 1D shows an isometric view of the flow gate closure unit in fully open position according to an embodiment of the disclosure.

In many cases it is desirable that the sliding gate 48 be retained so that it doesn't fully exit the gate exit aperture 36. FIGS. 1D, 3A, and 3B show that one way to do this is to employ at least one retaining stop 110 coupled to the outer surface 77 of the sliding gate to contact the top collar 24 when the sliding gate 48 is lifted to fully expose the principal aperture 28. The at least one retaining stop 110 may be sloped with a taller side 112 oriented towards the gate exit aperture 36. The taller side 112 is taller than whichever portion of the gate exit aperture 36 the retaining stop 110 may contact to block the sliding gate 48 from further displacement, thus facilitating retention of the sliding gate 48 within the closure body 12 during ordinary usage. The sloped nature of the at least one retaining stop 110 allows for insertion of the sliding gate 48 into the closure body 12 during assembly.

A flexible seal may be disposed around or adjacent an inner surface of the sliding gate with a footprint corresponding to the principal aperture 28 of the landing surface to prevent leakage when used with liquid and semi-solid contents.

Figure 4A:
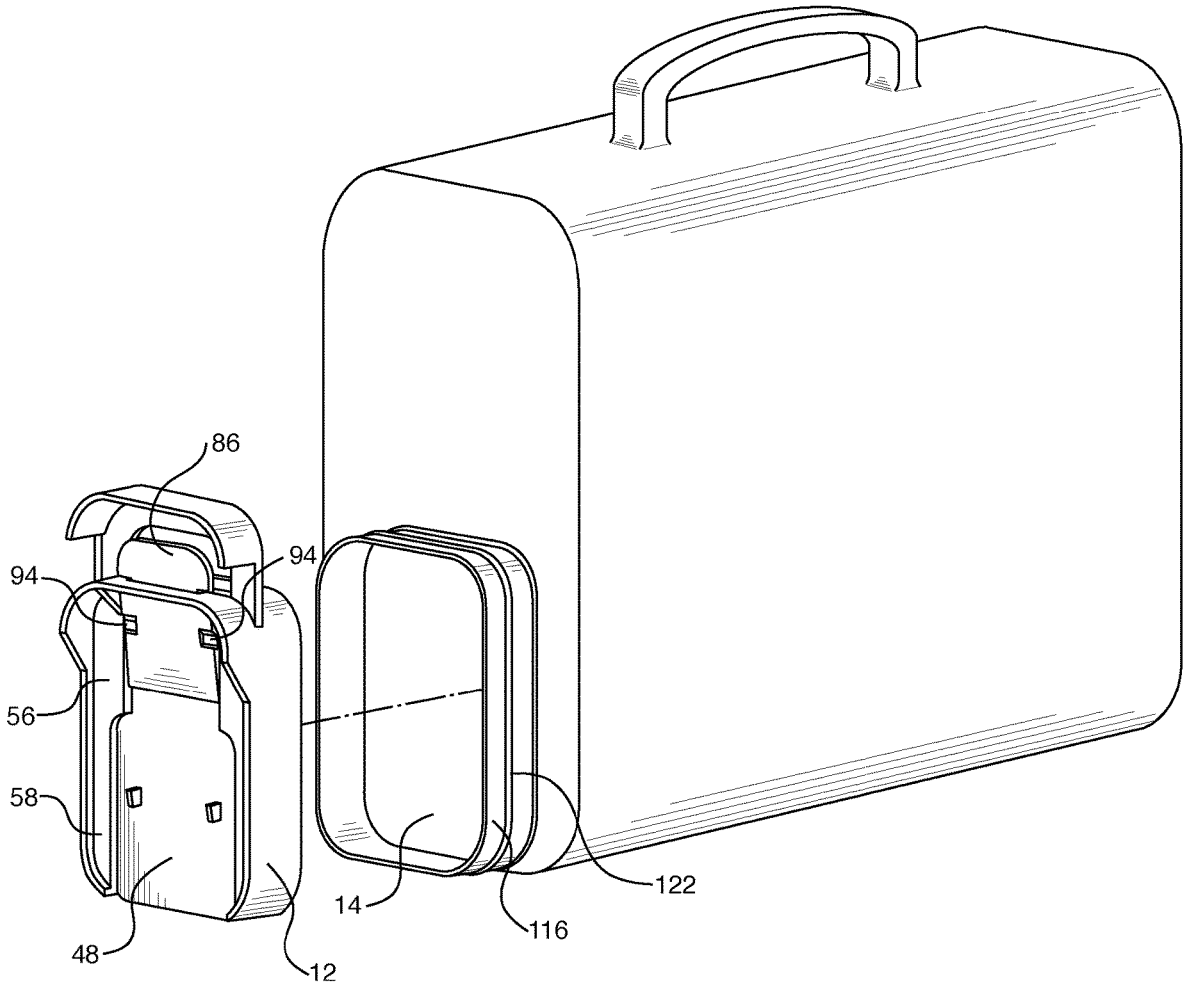
FIG. 4A shows an isometric exploded view of the flow gate closure unit and the container according to an embodiment of the disclosure.
Figure 4B:
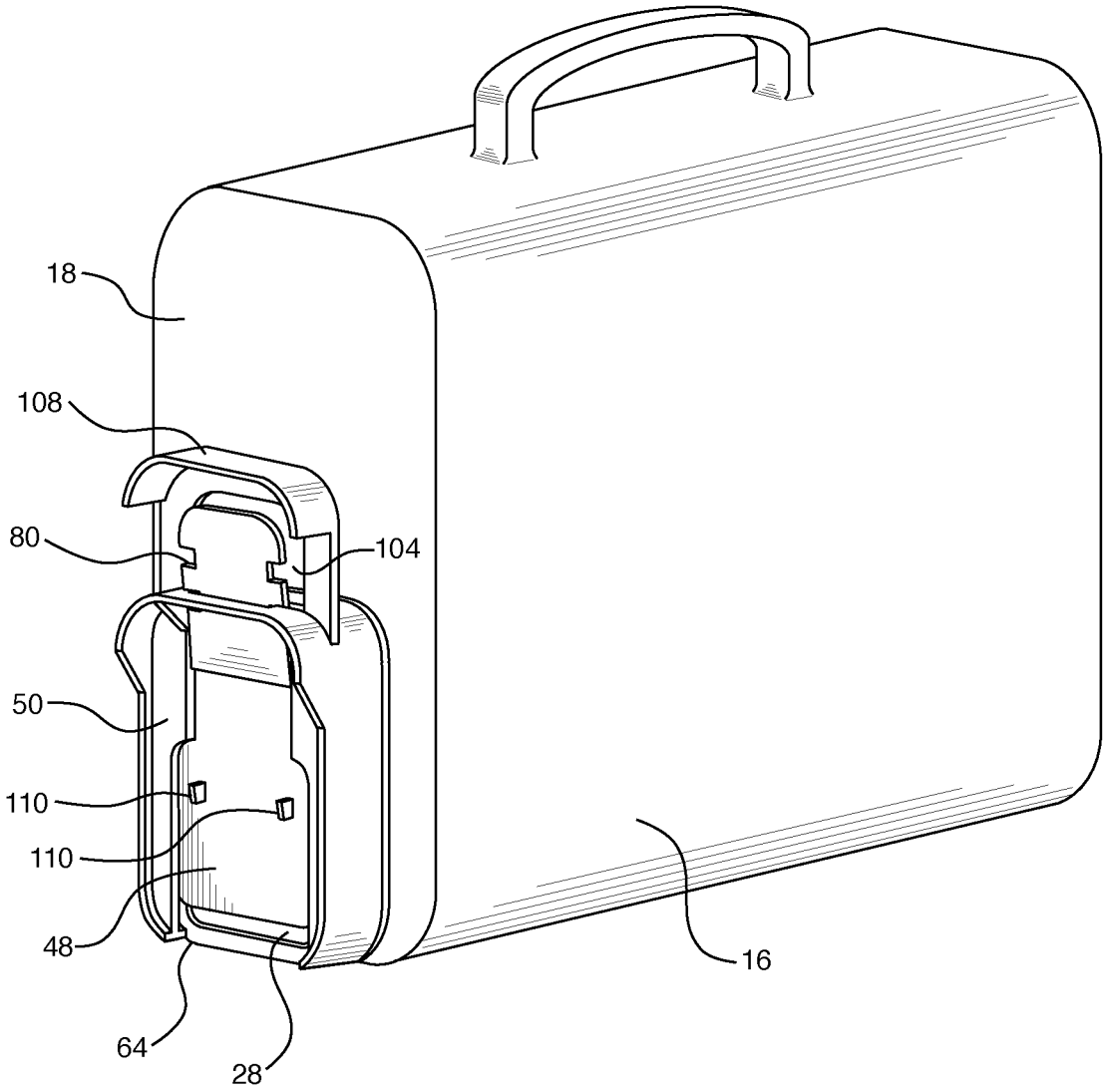
FIG. 4B shows an isometric view of the flow gate closure unit and the container according to an embodiment of the disclosure.
Figure 5A:
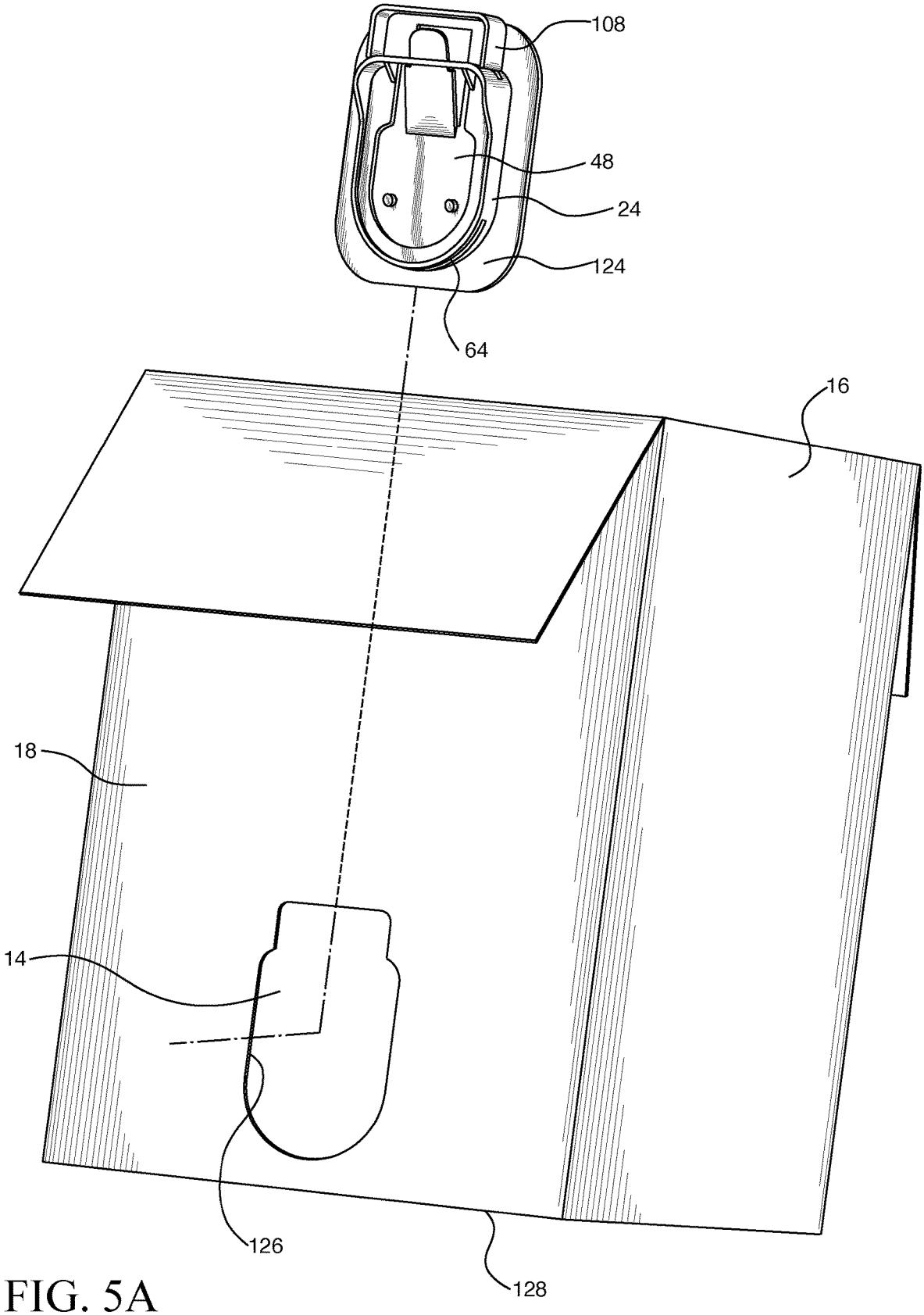
FIG. 5A shows an isometric exploded view of the flow gate closure unit and the container according to an embodiment of the disclosure.
Figure 5B:
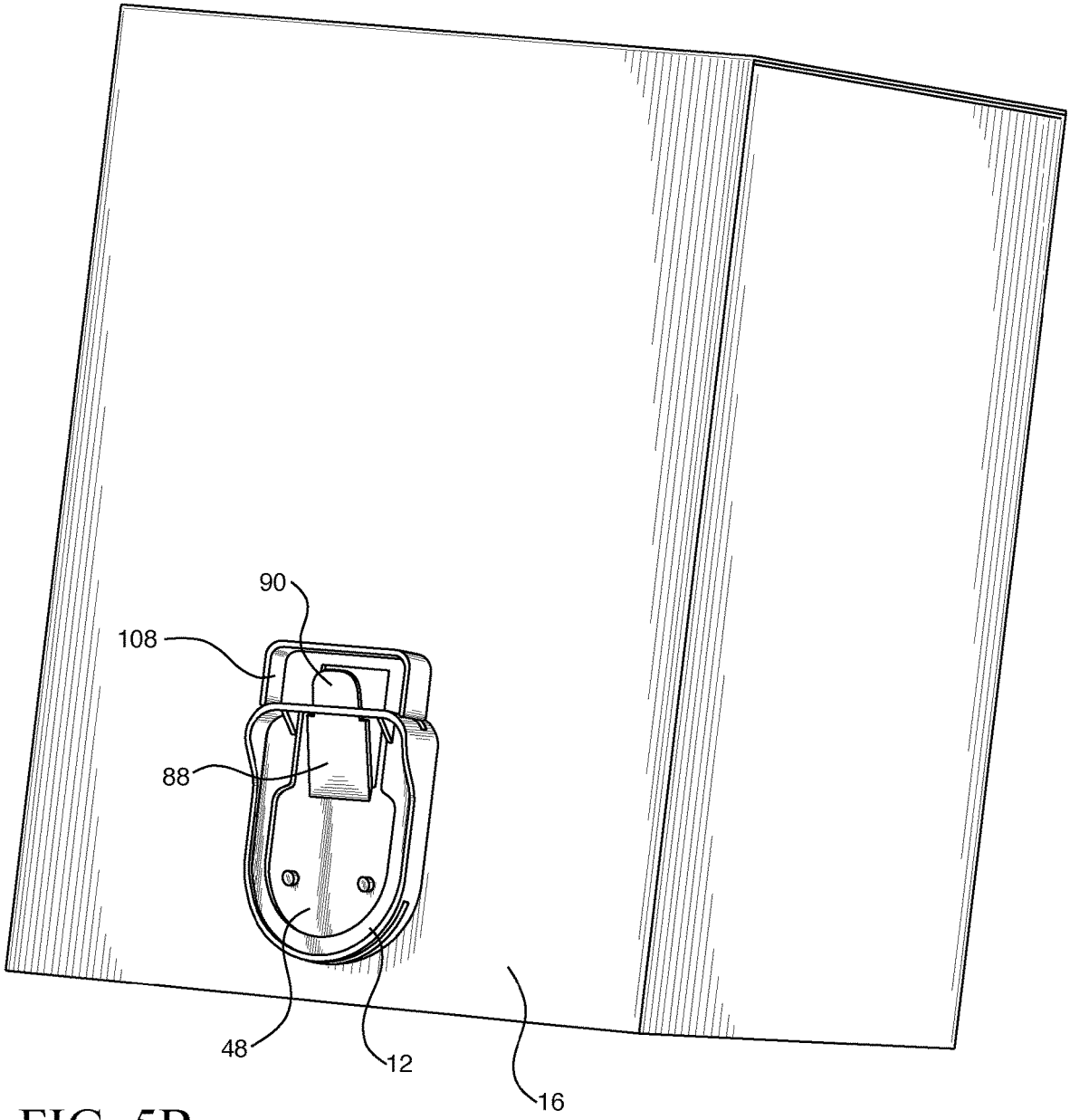
FIG. 5B shows an isometric view of the flow gate closure unit and the container according to an embodiment of the disclosure.

FIGS. 2B and 4A show that the closure body 12 may have a bottom collar 114 to receive a neck 116 of the container. The bottom collar 114 perpendicularly extends from the perimeter of the landing surface on the back surface 32 and may have a joining channel 118 within an inside face 120. The joining channel 118 is configured to receive a joining bead 122 on the neck of the container to provide one method of attaching the closure body 12 to the container 16. FIGS. 2D, 5A, and 5B show that there may be a flange 124 perpendicularly extending from the top collar 24 coplanar to the landing surface 22. The flange 124 is configured to provide additional surface area to adhere to the container 16 adjacent the principal opening 14, particularly when no neck is present. FIGS. 5A and 5B show the container with the principal opening positioned at a desirable closure location. The principal opening 14 of the container corresponds to the dimensions of the perimeter of the closure body 12 and any element of the sliding gate 48 extending therefrom, such as the pull handle 108. This will allow functional components of the closure body 12 and the sliding gate 48 to insert through the principal opening 14 from the inside of container to reveal it on the outside. The flange 124 contacts an internal wall 126 of the container and is mated using one of the aforementioned processes. The principal opening 14 can be positioned on any side of the container. However, to achieve optimal dispersal of the content, the principal opening 14 should be positioned as close to a bottom wall 128 of the container as possible to allow for a natural gravitational flow of the content without the need for the user to lift or tip the container 16 in any way.

Materials used to form these containers can vary widely and play no limit for the usage and implementation of this described closure to such container material. Examples of such materials used to make/form the container include plastic, cardboard, metal, and other common flexible materials.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A flow gate pour closure comprising:

a closure body, the closure body being configured to seal a principal opening of a container for a flowing content, the principal opening being positioned on a vertical wall of the closure body proximal a bottom wall thereof such that the content flows freely from an inside of the container therethrough, the closure body comprising:

a landing surface having a front surface, a back surface, and a principal aperture extending from the front surface through the back surface, the principal aperture being aligned with the principal opening of the container;

a top collar coupled to the landing surface, the top collar perpendicularly extending from a perimeter of the landing surface on the front side, the top collar having an inner face, an outer face, and a gate exit aperture extending from the inner face through the outer face; and a gate track for receiving a sliding gate through the gate exit aperture, the gate track extending from a top side to a bottom side of the top collar, the gate track defined by:

a gliding surface extending from the inner face of the top collar adjacent the gate exit aperture, the gliding surface in spaced apart opposition to the landing surface forming the gate track therebetween; and a sliding gate for blocking the principal aperture and regulating the content flowing therethrough, the sliding gate being slidingly translatable through the gate exit aperture within the gate track to expose the principal aperture to partially or completely allow the content to flow therethrough at a variable flow rate and translatable reciprocally back along the gate track to re-block the principal aperture and further comprising:

a depressible tab on the sliding gate, the sliding gate itself blocking the principal aperture, and constructed and arranged so that depressing the tab towards the sliding gate enables sliding gate movement through the gate exit aperture and translation back through the gate exit aperture, the tab partially engaging the gate exit aperture when the sliding gate fully blocks the principal aperture.

2. The flow gate pour closure of claim 1 further comprising the top collar having an overflow channel for clearing the gate track of debris from the content, the overflow channel extending from the inner face through the outer face of the bottom side of the top collar, the overflow channel fully occupying the bottom side of the top collar or alternatively being a slot through the bottom side of the top collar.

3. The flow gate pour closure of claim 2 further comprising the sliding gate having a channel extension on the bottom edge, the channel extension engaging the overflow channel to further clear the gate track when the sliding gate is moved to fully block the principal aperture.

4. The flow gate pour closure of claim 1 further comprising the depressible tab being of cantilever form with a proximal end fixed on an outer surface of the sliding gate and an unfixed free distal end and the gate exit aperture comprising a gate port and a stepped tab port, the gate port being adjacent the landing surface and the tab port extending above the gate port, the tab partially engaging a top tier of the tab port when the sliding gate fully blocks the principal aperture with the distal end extending through the gate exit aperture, the tab being manually depressible such that the tab is slidable through a second tier of the tab port to enable movement through the gate exit aperture, the tab selfdepressing to pass through the tab port when translating back through the gate exit aperture to re-block the principal aperture.

5. The flow gate pour closure of claim 4 further comprising the tab having a pair of locking notches below a tongue extension at the distal end, the pair of locking notches extending from a front face through a rear face of the tab, the tongue extension extending past the top tier and the pair of locking notches engaging the top collar when the sliding gate fully blocks the principal aperture, the tab being depressible by the tongue extension such that it passes through the second tier of the tab port.

6. The flow gate pour closure of claim 4 further comprising the tab having at least one pair of flow notches, the at least one pair of flow notches extending from the front face towards, but not through, the rear face of the tab, each of the at least one pair of flow notches having an angled ramp side more proximal the distal end of the tab, an angled lodge side more proximal the proximal side of the tab, and a flat portion between the ramp side and the lodge side, the flat portion engaging the top collar to maintain the sliding gate in a partially lifted position to allow the content of the container to pour at calibrated flow rates, the ramp side being angled to allow for disengagement with the top collar by pushing the sliding gate closed without manually depressing the tab, the lodge side being angled to allow for disengagement with the top collar by pulling the sliding gate further open without manually depressing the tab or alternatively being perpendicular the flat portion to require manual depression of the tab for disengagement with the top collar while pulling the sliding gate further open.

7. The flow gate pour closure of claim 1 further comprising at least one pair of flow ridges fixed on the outer surface of the sliding gate below the tab, each of the at least one pair of flow ridges partially engaging the top collar to require a slight increase in force to move through the gate exit aperture when translating the sliding gate to open or re-block the principal aperture, the sliding gate being secured in partially lifted positions between each pair of flow ridges to allow the content of the container to pour at calibrated flow rates.

8. The flow gate pour closure of claim 4 further comprising the tab having a body portion extending from the proximal end and a head portion extending from the body portion to the distal end, the head portion being thinner than the body portion to form a pair of shoulders, the head portion extending through the top tier and the pair of shoulders engaging the top collar when the sliding gate fully blocks the principal aperture, the tab being depressible by the head portion such that the pair of shoulders and the body portion are slidable through the second tier of the tab port.

9. The flow gate pour closure of claim 4 further comprising the sliding gate having a production aperture extending from the outer surface through an inner surface, the production aperture extending from adjacent the proximal end of the tab to beneath the distal end.

10. The flow gate pour closure of claim 1 further comprising a pull handle coupled to the sliding gate, the pull handle perpendicularly extending from a top edge of the sliding gate to provide an area from which a user can lift and depress the sliding gate while depressing the tab.

11. The flow gate pour closure of claim 1 further comprising a pair of beam supports coupled between the gliding surface and the top collar, the pair of beam supports extending from the inner face of the top collar on each side of the gate exit aperture to the gliding surface, the pair of beam supports providing structural integrity to a beam portion of the top collar above the gate exit aperture.

12. The flow gate pour closure of claim 1 further comprising the gliding surface continuously extending from the top side of the top collar adjacent a left side of the gate exit aperture around the bottom side to the top side of the top collar adjacent a right side of the gate exit aperture.

13. The flow gate pour closure of claim 12 further comprising the gliding surface having a wider portion adjacent the top side of the top collar and a lower rim connecting the wider portion adjacent each of the left side and the right side, the lower rim having a profile corresponding to the principal aperture.

14. The flow gate pour closure of claim 13 further comprising each of the bottom side of the top collar, a bottom edge of the sliding gate, and the lower rim of the gliding surface being rounded to produce a more controlled flow from the principal aperture.

15. The flow gate pour closure of claim 1 further comprising at least one retaining stop fixed on the sliding gate to contact the top collar and prevent the sliding gate from wholly escaping the closure body via the gate exit aperture in normal use.

16. The flow gate pour closure of claim 1 further comprising a flexible seal disposed around or adjacent an inner surface of the sliding gate and having a footprint corresponding to the principal aperture of the landing surface.

17. The flow gate pour closure of claim 1 further comprising a bottom collar coupled to the landing surface, the bottom collar perpendicularly extending from a perimeter of the landing surface on the back surface, the bottom collar being configured to receive a neck of the container.

18. The flow gate pour closure of claim 17 further comprising the bottom collar having a joining channel within an inside face, the joining channel being configured to receive a joining bead on the neck of the container.

19. The flow gate pour closure of claim 1 further comprising a flange perpendicularly extending from the top collar, the flange being coplanar to the landing surface, the flange being configured to provide additional surface area to adhere to the container adjacent the principal opening.

20. A combination flow gate pour closure and container comprising:

a container for a flowing content, the container having a principal opening positioned on a vertical wall of the closure body proximal a bottom wall thereof such that the content flows freely from an inside of the container therethrough;

a closure body coupled to the container, the closure body extending through the principal opening of the container, the closure body comprising:

a landing surface having a front surface and a back surface, and a principal aperture extending from the front surface through the back surface, the principal aperture being aligned with the principal opening of the container, the landing surface engaging the inside of container to secure the closure body to the container;

a top collar coupled to the landing surface, the top collar perpendicularly extending from a perimeter of the landing surface on the front side, the top collar having an inner face, an outer face, and a gate exit aperture extending from the inner face through the outer face; and a gate track for receiving a sliding gate through the gate exit aperture, the gate track extending from a top side to a bottom side of the top collar, the gate track defined by:

a gliding surface extending from the inner face of the top collar adjacent the gate exit aperture, the gliding surface in spaced apart opposition to the landing surface; and a sliding gate for blocking the principal aperture to prevent the content from flowing therethrough, the sliding gate being slidingly translatable through the gate exit aperture within the gate track to expose the principal aperture to partially or completely allow the content to flow therethrough at a variable flowrate and translatable reciprocally back along the slide track to re-block the principal aperture and further comprising:

a depressible tab on the sliding gate, the sliding gate itself blocking the principal aperture, and constructed and arranged so that depressing the tab towards the sliding gate enables sliding gate movement through the gate exit aperture and translation back through the gate exit aperture, the tab partially engaging the gate exit aperture when the sliding gate fully blocks the principal aperture.

* * * * *